United States Patent [19]

Hembling

[11] 4,420,884

[45] Dec. 20, 1983

[54] CAMMING SCISSORS

[75] Inventor: William G. Hembling, Milford, Conn.

[73] Assignee: The Scott & Fetzer Company, Shelton, Conn.

[21] Appl. No.: 329,813

[22] Filed: Dec. 11, 1981

[51] Int. Cl.[3] ..... B26B 13/06

[52] U.S. Cl. ..... 30/266; 76/104 A

[58] Field of Search ..... 30/266, 267, 341, 254, 30/257; 76/104 A

[56] References Cited

U.S. PATENT DOCUMENTS

| | | | |
|---|---|---|---|
| 523,950 | 7/1894 | Thompson | 30/266 |
| 1,882,218 | 10/1932 | Harvey | 30/266 X |
| 1,947,964 | 2/1934 | Beckmann | 30/254 |
| 2,627,656 | 2/1953 | Richartz | 30/341 X |

FOREIGN PATENT DOCUMENTS

| | | | |
|---|---|---|---|
| 94806 | 11/1897 | Fed. Rep. of Germany | 30/266 |
| 625221 | 6/1949 | United Kingdom | 30/266 |

*Primary Examiner*—Jimmy C. Peters

*Attorney, Agent, or Firm*—Pearne, Gordon, Sessions, McCoy, Granger & Tilberry

[57] ABSTRACT

Scissors construction wherein sheet metal stock is pressed into a blade having a control cam for establishing point contact and improving the feel of action between pivoted blade pairs. The blade is coined in a die assembly to form the control cam and an arcuate blade cross section which rigidifies the blade and produces the effect of hollow grinding.

5 Claims, 14 Drawing Figures

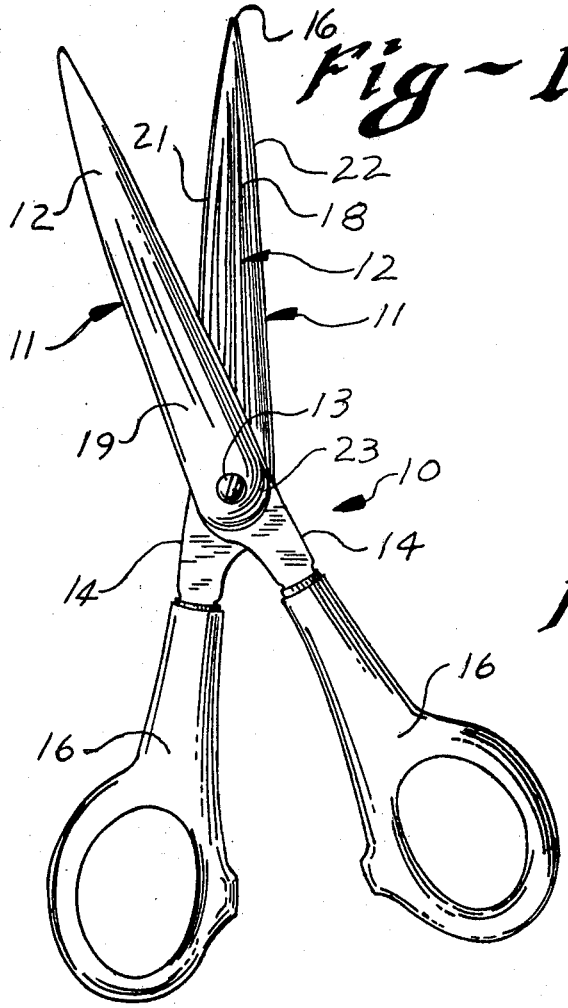
Fig~1
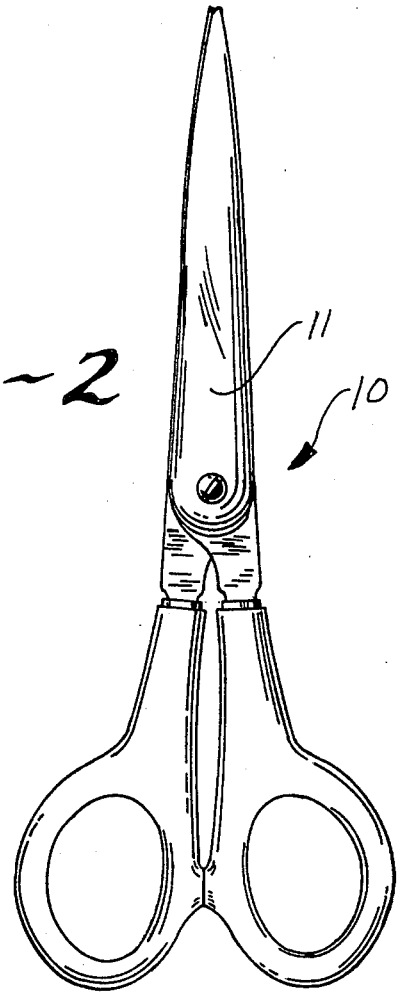
Fig~2
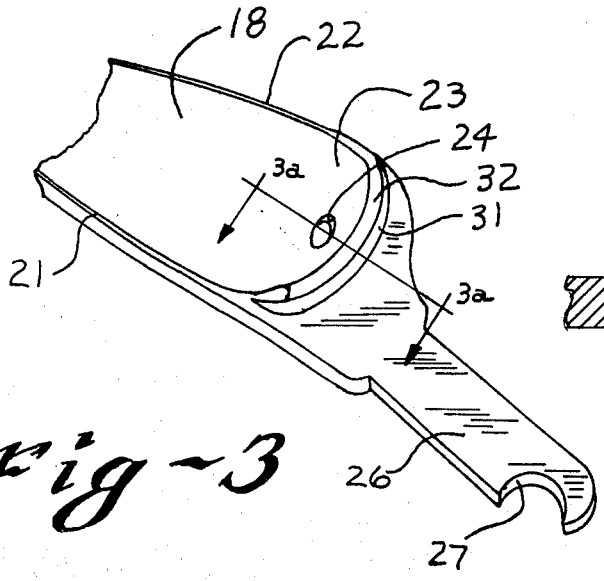
Fig~3
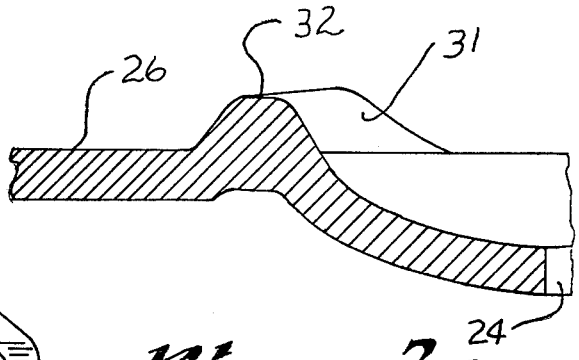
Fig~3a

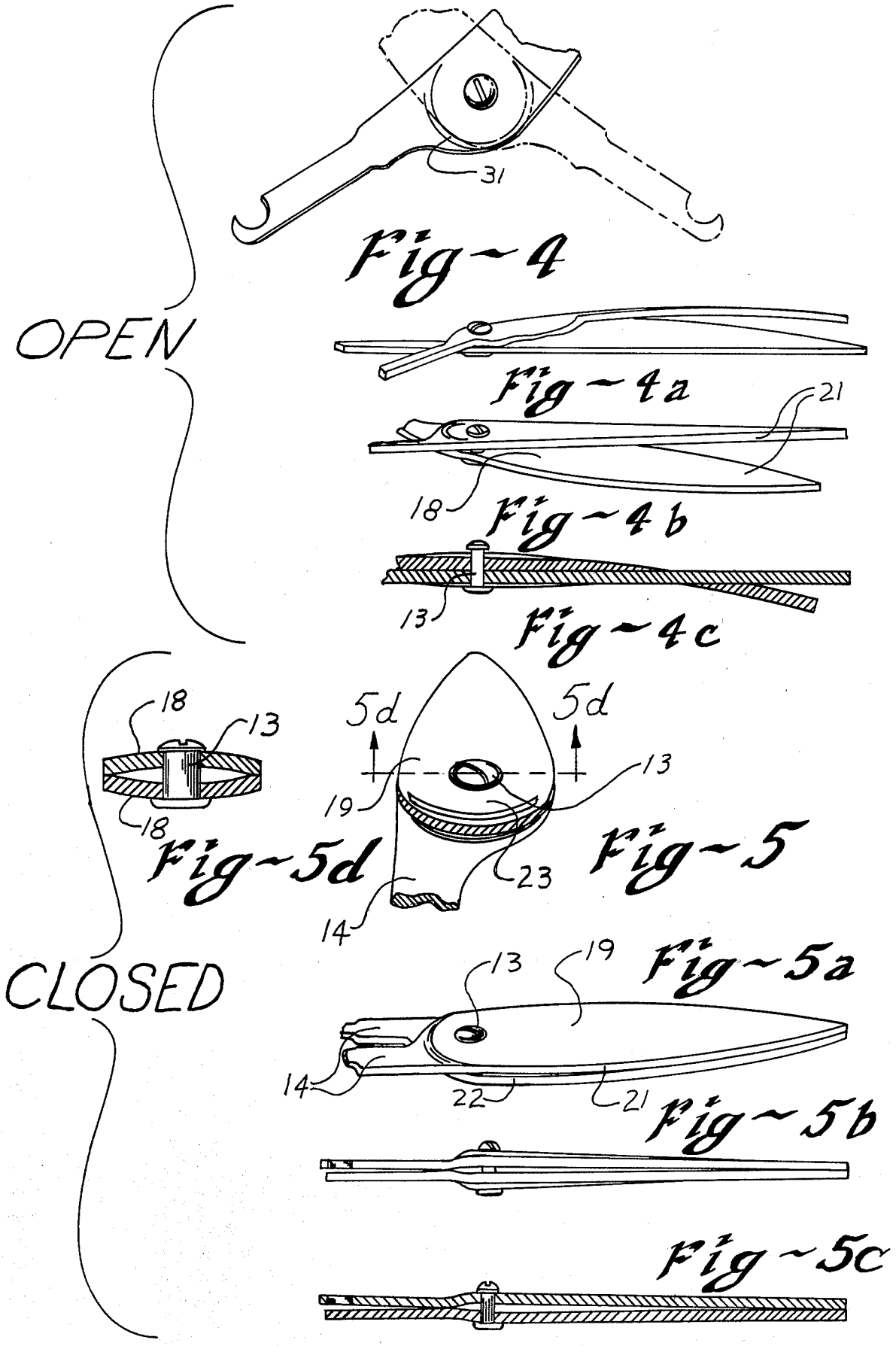
31
Fig~4
OPEN
Fig~4a
21
18
Fig~4b
13
Fig~4c
18
13
18
Fig~5d
5d
5d
13
19
23
14
Fig~5
CLOSED
13
19
Fig~5a
14
22
21
Fig~5b
Fig~5c

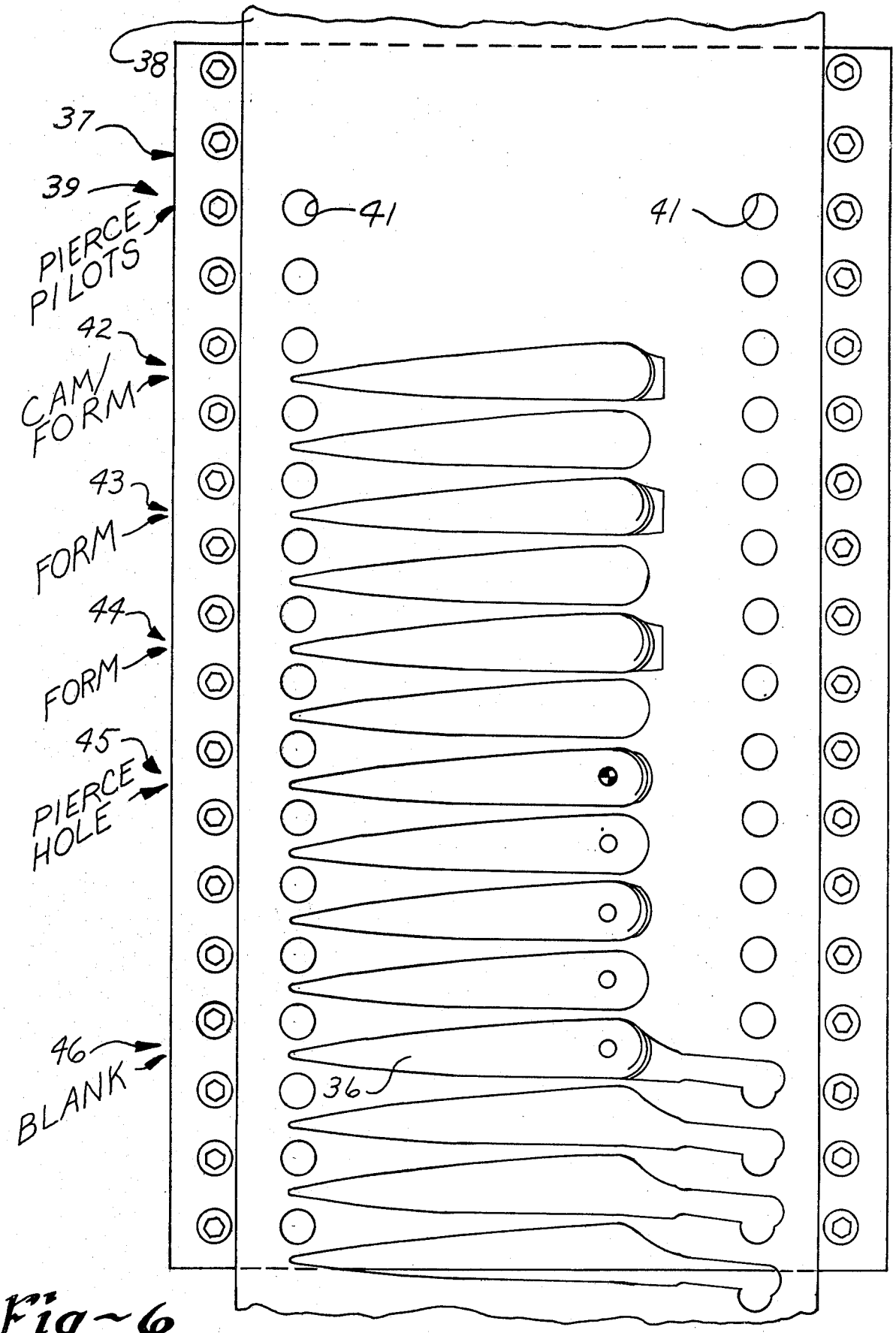
Fig~6

CAMMING SCISSORS

BACKGROUND OF THE INVENTION

The invention relates to improvements in shear-type tools, and in particular to an improvement in the construction of scissors and like implements.

PRIOR ART

It is recognized that a pair of scissors for proper cutting action preferably has its blades contacting at a single point that moves along the blades outwardly away from their pivot towards their tips as they are closed. This ideal operation has been traditionally achieved by hollow grinding the inner faces of the blades and/or providing a slight set or bow in the length of the blades. U.S. Pat. Nos. 1,956,588 to Parker et al.; 3,376,641 to Usborne; 3,688,402 to Shannon; and 4,133,107 to Vogel disclose cam or camlike elements on the shank portions of the blades to influence cutting action of the blades.

SUMMARY OF THE INVENTION

The invention provides a scissors construction in which the blades are pressed from sheet metal with a unique configuration that achieves the ideal of point contact between the blades. This unique configuration is impressed upon the blades automatically during their blanking operation, thereby eliminating any subsequent handling and working, manual or automatic, to produce or complete such configuration.

The configuration impressed upon a blade is like a bird's bill, with both a hollow cross section in its cutting portion and a control cam area in its shank portion. Preferably, the blade is pressed into shape in a coining operation wherein it is restricted by die members on both of its faces for a high degree of precision in its formation. The hollow blade cross section and control cam individually and mutually cooperate to produce a high quality cutting action and feel, with little or no subsequent processing such as hollow grinding or setting.

As disclosed, during the blanking and stamping operation of the blade, the cutting portion is formed with a hollow or concave inner face, while the shank portion is formed with a spheroidal area that merges smoothly with this cutting portion hollow. At the junction of the cutting and shank portions is a hole which accommodates the pivot pin. The geometric base of the spheroidal or spoon-shaped shank area is substantially concentric with the axis of this pivot hole. The leading cutting edge and the trailing edge of the blade cutting portion and the base of the spheriodal shank area are generally coplanar so as to define the nominal plane of the blade.

Along the base of the spheroidal shank area is formed the control cam, which projects beyond the nominal plane of the blade towards the space of the opposite blade. As hereinbelow explained, the control cam serves to both tilt its respective blade about a longitudinal axis to ensure point contact between the blades and to rock its blade about an axis transverse to the longitudinal direction to maintain such point contact.

The hollow cross section of both the cutting portion and spheroidal area of the shank portion of the blade advantageously rigidifies these areas for uniform, improved cutting action and feel. This stiffening capability of the hollow cross sections allows a blade to be fabricated from relatively light gauge sheet stock, while still affording positive cam control action. Use of light gauge sheet stock, as permitted by the invention, results in an article which is relatively light in weight, and therefore comfortable and nonfatiguing in use. Further, the blades require minimal material for their fabrication, and tooling loads are reduced in proportion to their reduced gauge thickness. The disclosed blade is adapted to be paired with an identical piece for economies in tooling, inventory, and assembly steps.

BRIEF DESCRIPTION OF THE DRAWINGS

FIG. 1 is a side view of a pair of scissors constructed in accordance with the invention and illustrated in an open position;

FIG. 2 is a side view of the scissors in a closed position;

FIG. 3 is a fragmentary, perspective view of the midsection of one blade of the scissors;

FIG. 3*a* is a fragmentary cross section, on an enlarged scale, of the scissors blade taken at the line 3*a*—3*a* indicated in FIG. 3;

FIGS. 4 and 4*a* through 4*c* illustrate portions of the scissors in an open position;

FIGS. 5 and 5*a* through 5*d* illustrate portions of the scissors in a closed position; and FIG. 6 is a schematic plan view of a progressive coining die assembly for forming the scissors blades from sheet stock.

DESCRIPTION OF THE PREFERRED EMBODIMENT

Referring now to the drawings, and in particular to FIGS. 1 and 2, there is shown a pair of shears or scissors 10. The scissors 10 comprise a pair of blades 11 which are identical. The blade 11 has a cutting portion 12 to one side of a pivot pin 13 and a shank portion 14 on the opposite side of the pivot pin. The shank portions 14 of the blade pair in the illustrated case are fitted with identical injection-molded plastic handles or finger grips 16.

The blade 11 is formed from sheet metal stock, for example, 0.070 inch stainless steel where in the illustrated case the scissors 10 are nominally 6 inches long from cutting tip 16 to the far ends of the handle grips 16. The cutting portion 12 is formed as an arcuate channel (FIG. 5*d*) along substantially its full length, so that its inner face 18 is hollow or concave and its outer face 19 in convex, as is revealed in cross section, transverse to its length. In side view, the blade cutting portion 12 has an elongated, tapered profile terminating at the cutting tip point 16.

Longitudinal edges 21,22 of the blade cutting portion 11 are substantially coplanar with each other and with a distal area of the shank portion 14. An area 23 of the shank portion adjacent the pivot pin 13 is spheroidal, in the manner of a spoon, so that it extends out of the nominal plane of the shank portion 14 and merges smoothly with the arcuate cross section of the cutting portion 12 at an imaginary plane transverse to the length of the cutting portion and passing through a hole 24 provided for the pivot 13. The spheroidal or spoon-like shank area 23 meets the plane of the remainder of the shank 14 along a base line which is generally concentric with the axis of the pivot hole 24. As shown in FIG. 4, for example, the distal area of the shank 14 has a flat stem section 26 which is adapted to be received in a suitable cavity in the plastic handle grips 16. A notch 27 in the stem 26 provides means for anchoring the stem in the handle cavity where material of the handle is caused, by compression or relaxation of handle material, to extend into the notch 27.

Where the base of the spheroidal shank area 23 joins the plane of the flat shank area, there is formed a blade cutting control cam 31. In plan view of the plane of the shank, the control cam 31 is concentric with the pivot hole 24. The cam 31 extends inwardly of the plane of the shank 14, with its lift increasing in a direction from the trailing edge 22 to the cutting edge 21, i.e., increasing in a clockwise direction as viewed in FIG. 3. An active surface 32 of the cam 31, as viewed in FIG. 3, is thus generally helical with respect to the axis of the pivot hole 24. Preferably, the active surface area 32 of the control cam has a constant pitch angle so that its lift increases linearly with angular displacement taken with reference to the pivot hole 24.

Blanks 36 for forming the blades are automatically produced in a die assembly 37, schematically shown in FIG. 6. In the die assembly, sheet stock is pressed to shape between opposed coining or like stamping dies. A strip of metal sheet stock 38 is fed stepwise by conventional means through the die assembly 37 from the top to the bottom of FIG. 6. At a first station 39, pilot holes 41 are punched though the sheet 38 by suitable punches for purposes of indexing the sheet as it is progressively stepped through the die assembly 37. At a second station 42, the sheet is forcibly pressed between opposed die surfaces on opposite sides of the sheet to accurately coin the cam 31 into the desired shape. At the station 42 and successive stations 43, 44 the three-dimensional convex/concave form of the blade cutting portion 12 is developed by die coining surfaces acting upon and confining opposite sides of the sheet 38. At a subsequent station 45, the pivot hole 24 is punched through the sheet 38. At a final work station 46, the blade blank 36 is blanked, i.e, sheared from the sheet 38.

Blade blanks 36 produced by the die assembly 37 are finished by grinding their lead cutting edges 21 and, where desired, by slightly longitudinally bowing or "setting" their cutting portions 12. After grinding and setting, a pair of blades 11 are joined together by assembling the pivot pin 13 in their holes 24 and upsetting it like a rivet in a conventional manner.

As indicated in FIG. 4*c*, the pivot upset leaves a few thousandths of an inch clearance with the combined thickness of the blades 10, as measured at the pivot holes, when they are overlying each other in a completely open position. As the blades 11 are moved from an open to a closed position, the control cams 31 overlie one another such that their pitch or rise becomes additive.

The control cams 31 in sliding contact over one another improve cutting action by causing the planes of the blades 11, as defined by the locus of their respective lead and trailing edges 21,22, to skew or tilt relative to one another in two components of motion. The first component of motion developed by the cams 31 is a tilting or rocking of the blades about axes transverse to the blade lengths in the zone of the rivet where the rivet becomes a fulcrum as the cams force the shank portions apart and thereby press the cutting portions together. The second component of movement gnerated by the cams 31 is rotative along axes generally parallel to the lengths of the blades, where the blades skew relative to one another at an angle equal to twice the helix angle of a single cam. The first-described component of motion developed by the cams 31 tends to hold the blade cutting portions in contact. The second-described component of motion generated by the cams 31, coupled with the hollow faces of the blades and the longitudinal bow or set of the blades, ensures that contact between the blades will be at a single point which travels outwardly with reference to the pivot along the cutting edges 21 as the blades are closed.

The three-dimensional bird bill configuration of the blade cutting portion 12 and adjacent spheroidal area 23 of the shank portion put the action of the control cam 31 to full advantage. Both these blades areas 12, 23 exhibit requisite stiffness even where the blade is fabricated of relatively thin sheet stock. The cams 31, ideally situated at the base of the spheroidal area 23, can devlope relatively high lift forces to maintain the cutting edges 21 in contact without undue local deflection in the spheroidal shank area 23 or in the blade cutting portion 12.

The disclosed method of stamping the cam 31 to final form in opposed coining die faces yields a precision cam profile in finished form as it leaves the die assembly 37 and requires no significant additional machining or like work. The degree of precision required and obtained can be appreciated where, for example, as in the illustrated case, the total lift of a cam of approximately 0.010 inch and the thickness of the sheet stock is nominally 0.070 inch. As indicated in FIG. 3*a*, the thickness of the sheet stock is not significantly reduced in the area of the cam 31 but, rather, the cam is characterized by a depression in the outer face 19 of the blade 11. By forming the cam 31 in the same die assembly 37 that the blade blank 36 is formed and pierced for the hole 24, the cam is precisely and uniformly located on the body of the blade. As a result, uniform cutting action in the final product is achieved without expensive subsequent grinding and other processing of the blanks 36 produced by the die assembly 37.

It should be evident from the foregoing that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. Scissors comprising a pair of blades connected at a pivot, the blades each having mutually cooperating elongate cutting portions on one side of the pivot and handle shank portions on the opposite side of the pivot, said blades being pivotal about said pivot from an open position in which said cutting portions form an acute angle to a closed position where they are generally superposed, said blades being formed from sheet steel and being of generally uniform thickness, said blades having inner and outer faces, said inner faces being concave substantially along the full length of said cutting portions and said outer faces of said cutting portions being correspondingly convex, the profile of said cutting portion faces being substantially described by lead and trailing edges, the lead edges of said cutting portions forming the cutting surfaces of said blades, the shank portion of a blade including integral cam means embossed in the sheet material of its body to tilt the blades relative to one another to promote contact between the cutting edges of said blades and avoid contact of said trailing edges of said blades, the cam means embossment being disposed on the arc of a circle generally concentric with said pivot, the shank portion between said cam embossment and said pivot comprising substantially entirely a hollow spheroidal area which merges smoothly with the associated cutting portion whereby the cam embossment and spheroidal shank area are mutually reinforced and stiffened.

2. Scissors as set forth in claim 1, wherein the lead and trailing edges of each blade are substantially in a common plane, said cam means extending inwardly of the common plane of its blade.

3. Scissors as set forth in claim 1, wherein said cam embossment has an active surface which is helically oriented with respect to said pivot.

4. Scissors as set forth in claim 1, wherein said blades are substantially identical.

5. Scissors comprising a pair of blades connected at a pivot, the blades each having mutually cooperating elongate cutting portions on one side of the pivot and handle shank portions on the opposite side of the pivot, said blades being pivotal about said pivot from an open position in which said cutting portions form an acute angle to a closed position where they are generally superposed, said blades being formed from sheet steel and being of generally uniform thickness, said blades having inner and outer faces and an arcuate profile in section transverse to their length, said inner faces being concave substantially along the full length of said cutting portions and said outer faces of said cutting portions being correspondingly convex, the profile of said cutting portion faces being substantially described by lead and trailing edges cooperatively defining the plane of the blade, the lead edges of said cutting portions forming the cutting surfaces of said blades, the shank portions of said blades including a hollow spheroidal area adjacent said pivot, said spheroidal area merging with the arcuate profile of the cutting portion at an imaginary plane transverse to the length of the blade and passing through the area of the pivot, a base of the spheroidal area intersecting an area of the shank spaced from the pivot generally at the plane of the blade, a blade control cam integrally formed on a blade adjacent the base of the spheroidal area and concentric with the pivot, the control cam being constructed and arranged to bias the blades into point contact along their cutting surfaces by simultaneously, upon closing movement of said blades, skewing the plane of the blade by rotation on an axis parallel to the length of the blade and by tilting the plane of the blade by rocking it on the pivot about an axis transverse to the length of the blade.

* * * * *